United States Patent [19]

Marshall et al.

[11] 4,189,329

[45] Feb. 19, 1980

[54] HALOGEN-CONTAINING PLASTIC REFUSE TREATMENT

[76] Inventors: David R. Marshall, 1306 Treme, New Orleans, La. 70016; Ronal C. Morie, 140 Roseacre, St. Louis County, Mo. 63119

[21] Appl. No.: 358,629

[22] Filed: May 9, 1973

[51] Int. Cl.[2] ..... B08B 15/00

[52] U.S. Cl. ..... 134/5; 29/403.1; 432/15; 134/19

[58] Field of Search ..... 134/2, 7, 19, 6, 20, 134/25, 38, 42, 5; 29/403; 423/240, 241, 490, 497, 499; 55/71, DIG. 41; 432/15, 18, 58, 72, 215; 261/17, 115; 34/72; 23/277 C, 288 S; 422/139

[56] References Cited

U.S. PATENT DOCUMENTS

| | | | |
|---|---|---|---|
| 1,458,651 | 6/1923 | Goldschmidt | 423/497 X |
| 2,686,151 | 8/1954 | Feldbauer et al. | 423/490 X |
| 3,053,704 | 9/1962 | Munday | 134/7 X |
| 3,250,643 | 5/1966 | Sergent | 134/7 X |

OTHER PUBLICATIONS

*Chem. Abstr.*, vol. 69:102699b (1968).

*Primary Examiner*—Richard V. Fisher
*Attorney, Agent, or Firm*—Ralph W. Kalish

[57] ABSTRACT

The method of treating halogen-containing plastic refuse which comprises charging same to a bath for immersion therein, the bath being constituted of an inorganic carbonate, such as from the class consisting of alkali and alkaline earth metals; such bath being in a highly particulate condition. The bath is heated to, and maintained at, the appropriate temperature for effecting thermal decomposition of the plastic but below calcination temperature. Such method includes preventing discharge to the atmosphere of the halogenic material released.

6 Claims, No Drawings

HALOGEN-CONTAINING PLASTIC REFUSE TREATMENT

BACKGROUND AND SUMMARY OF THE INVENTION

This invention relates in general to environmental pollution and, more particularly, to a method for treating halogen-containing plastic refuse to prevent halogens and halogen compounds from being released for causing environmental pollution. The present method also has application within the field of scrap metal salvage whereby metals normally encased in halogen-containing plastic materials may be recovered.

The disposal of plastic refuse is a continuing problem of ever-increasing proportions confronting our society. The seemingly endless utilization of plastic in industry, as well as in the production of infinite products, causes the concern for disposing of such material after the particular devices have served their intended purposes to be one of almost incomprehensible immensity.

However, in addition to the problems attendant with disposing of the rapidly increasing volume of plastic trash, there exists the more critical matter of disposing of plastics which contain halogen so that the particular treatment will not bring about a release into the environment of either the halogens or compounds thereof. For instance, burning of halogen-containing plastics in the atmosphere would cause the discharge of such halogenic material with imperiling of health, as well as with destructive tendencies to materials incorporated in neighboring constructions. As an example, the release of chlorine either as a gas or as hydrogen chloride would cause development of hydrochloric acid by reason of atmospheric moisture content, and the corrosive nature of such is well known. Experience has also indicated that similar release occurs when halogen-containing plastics are disposed of in land fills.

Although the number of halogen-containing plastics are myriad, those most widely utilized commercially at the present time are polyvinyl chloride, polyvinyl fluoride, and polyvinylidene chloride. But the prospects are that additional compounds of this type will be formulated and will undoubtedly find new uses with enhanced need to effectively treat such material when discarded.

Currently, plastics of the type hereunder consideration have found wide usage for insulation of electrical wires and in view of the aforesaid attendant drawbacks in disposing of such halogen-containing plastics, there have been concomitant difficulties in the recovery of metal covered thereby.

To the present time, techniques for removing polyvinyl chloride coatings from metals have been fundamentally of two types: one wherein the scrap is subjected to mechanical chopping; and the other by burning of the insulation in the atmosphere. With mechanical chopping it has been found that the heat generated by such operation has been sufficient to cause a melting of the polyvinyl chloride with resultant clogging of the equipment, as well as presenting a fire hazard, which, if realized, would cause unrestricted production of hydrochloric acid.

Another drawback of burning in the atmosphere, besides the undesired release of halogenic material to the atmosphere, is the difficulty in controlling the temperature of such burning whereby oxides of the metals to be recovered may be formed as well as a melting of the metal. To the present time salvage of halogen-containing plastic clad metals has been most unsatisfactory.

Therefore, it is an object of the present invention to provide a method for treating halogen-containing plastic refuse to prevent any released halogens or compounds thereof from polluting the atmosphere or bringing about conditions deleterious to neighboring structures.

Another object of the present invention is to provide a method of the type stated which may be most economically performed; which is effective; and which is fully reliable; providing an answer to a problem which has long beset society and which can only serve to remove inhibitions from further research into the use of plastics of such character.

It is another object of the present invention to provide for recovery of metals which are normally coated with halogen-containing plastic materials, as for electrical insulation purposes.

Another object of the present invention is to provide a method of the character stated which is performed with facility and being productive of the original metal without formation of significant quantities of oxides or other undesired compounds; and which is markedly efficient, providing maximum metal yield.

It is a still further object of the present invention to provide a method for salvaging metal from halogen-containing plastic coatings, claddings, encasements and the like, which is of extreme versatility and which requires simplicity of equipment.

It is another object of the present invention to provide a method of the character stated which does not alter significantly the metal salvaged, so that the same is capable of being further processed, if desired, in accordance with current techniques.

It is a fundamental object of the present invention to provide a method which is of anti-pollutional character and simultaneously effective for metal salvage.

DESCRIPTION OF THE INVENTION

In essence, the present invention contemplates the immersion of halogen-containing plastics within a bath of a carbonate, such as, for example, calcium carbonate, and preferably in particulate form, for a predetermined period of time within a predetermined temperature range for effecting heat decomposition of the plastic and with the release of the particular halogen, whether as a free gas, or as a salt, for harmless reaction with the carbonate. The temperature range will be determined at its lower limit by the temperature at which the particular plastic will thermally decompose and at its upper limit by the temperature at which the particular bath will calcine. Thus, the ceiling temperature is such as to prevent calcination; it being recognized that such temperature will vary with the particular carbonate or group of carbonates forming the bath. For purposes of numbers alone, such upper limit would be expectedly approximately between 1500°–1700° F., but such is not considered to be restrictive. The lower limit for all practical purposes would not be below approximately 400° F.

The bath of the present invention is preferably an alkaline earth metal carbonate, such as, calcium carbonate, magnesium carbonate, strontium carbonate, and barium carbonate. However, alkali metal carbonates are equally useful for bath constitution, such as, sodium carbonate, potassium carbonate, and lithium carbonate. In view of its relative availability and, hence, with expected economy, calcium carbonate would be the compound of commercial choice. Limestone, such as sandy limestones, as well as chalks, marbles, calcite, and the like are readily available forms of calcium carbonate for the present invention. It is, however, understood, that other forms of calcium carbonate are of like utilitarian value, such as, in various types of shells, etc., and material of synthetic and natural combinations and mixtures of alkaline earth and alkali metal carbonates, for example, Dolomite, are other effective sources of bath composition.

For bath development, the carbonate, such as limestone, is comminuted or otherwise reduced to a small particulate character, one being conducive to ease of fluidization as well as to provide maximum surface for heat exposure. A range within 20–300 mesh would be adequate for this purpose. Thus, the granulated carbonate is charged to a vessel or tank of suitable volume preparatory to receiving the plastic scrap or refuse to be treated. The bed or bath of carbonate is adapted for receiving a flow of heated or unheated air which is forced therethrough under requisite pressure for fluidization of the bed with the air thus bubbling upwardly through the mass thereof, as for heating of the bed when the air is preheated and to facilitate immersion of the scrap. The vessel may be connected, as by a conduit in its base portion, to a combustion air blower from which the air, heated or otherwise, is directed into the bath.

The present method is described generally as follows: With the carbonate, such as calcium carbonate, forming the bath, the same is heated to a temperature effective for decomposing the halogen-containing plastic material to be supplied to the bed. Said plastic material to be treated is then fully immersed within the bath with the temperature of the latter causing a heat decomposition of the plastic. Due to the exothermic character of the reaction the temperature of the bath will be elevated as the decomposition proceeds. The ultimate temperature of the bath is determined by the character of the plastic material being treated and may be controlled by regulating the air flow through the bath, but with the recognition that the temperature will not exceed that at which calcination of the bath carbonate would occur.

Gas-liquid chromatographic analysis or other appropriate method of analysis may be employed to indicate the cessation of evolution of hydrocarbon gases and, hence, determination of the thermal degradation of the plastic being treated. It is to be observed that the plastic is maintained in a fully immersed condition, that is, surrounded by the bath and, hence, is not exposed to the atmosphere during the decomposition process. It is an effectively controlled atmosphere within which the decomposition occurs and which fact is condusive to maintenance of the bath at approximately the particularly desired temperature.

It should be understood that fluidization of the bath would be a desired condition for producing maximum contact between the particulate bath and the plastic to be treated for ultimate effectiveness as for immersing the plastic. Thus, the bed of finely divided particles is, through fluidization, caused to be lifted and agitated by a rising stream of gas, such as air, with the particles at one end of the velocity range being substantially fully suspended in the gas (air) stream and being carried with it. Consequently, fluidization is a physical state tending to rapidly and economically effectuate the desired interreaction. As is evident from the foregoing, full immersion of the material to be treated within the bath is critical, but fluidization is a technique which would be most desirable in the present method to effect immersion and regulate temperature.

During the decomposition process, the halogen, as a gas, such as chlorine, or as a salt, such as hydrogen chloride, will be released from the polymer and reaction with the particular carbonate will occur. Thus, if hydrogen chloride is released the same would react, for example, with calcium carbonate to form calcium chloride with the release of water and carbon dioxide. Chlorine gas, such as $Cl_2$ would react directly with the calcium carbonate to cause formation of calcium chloride; however, it has been found that chlorine in this form will constitute but a minor amount of that released as by the decomposition of polyvinyl chloride. Like reactions occur between the particular carbonate and other halogencontaining plastics, such as, polyvinylidene chloride, polyvinyl fluoride, and the like, so that whether the halogen is in the form of a salt or a gas, as released, the escape of the same to the atmosphere is effectively prevented through substitution of the chloride ion for the carbonate ion with appropriate salt formation with the particular alkali metal or alkaline earth metal so that no deleterious results occur.

As a characteristic example of the efficacy of the present method, a batch of polyvinyl chloride trash is charged to the bath in any convenient manner, such as, for instance, by means of an open mesh container or basket which is completely immersed in the bath, within the tank; said latter being of appropriate volume so that the entire basket contents are fully immersed and with there being no vents through the bath. It is understood, however, that equipment utilized for performing the invention of this method is not critical and thus does not form a part of the present invention since the types of equipment useful are myriad. The quantity of the batch to be treated can be predetermined depending upon the capacity of the equipment but it has been discovered that batches in the order of 100 to 2000 pounds, regardless of the diversity of shapes and sizes of the scrap components may be handled with dispatch. In passing, it is not to be construed that the present method may be used only in a batch manner since it is well within the comprehension of those skilled in the art to effect a flow type procedure for this invention.

The bath, as in this case, calcium carbonate, has been heated to a temperature between the range of approximately 430° F. to 500° F. within which range the polyvinyl chloride commenced to decompose with attendant release of the chlorine and hydrogen chloride. The chlorine and the hydrogen chloride react with the calcium carbonate of the bath to form calcium chloride, there being water and carbon dioxide released. Thus, by reason of the foregoing reaction, escape of the halogen to the atmosphere is reliably prevented. The thermal decomposition of the polyvinyl chloride will continue to completion with the evolution of a complex mixture of volatile organic compounds which may be conducted through an exhaust gas afterburner and thence through suitable conventional air cleaning equipment. There may also be the formation of a carbonaceous, relatively non-volatile residue which may be easily discarded.

It is recognized that by the formation of calcium chloride, as with the present example, the effective concentration of carbonates in the bath will be reduced so that makeup carbonate must be fed to the reactor bed periodically. It is evident that the calcium carbonate will be consummed chemically and that some will also be lost through mere mechanical transference from the bath after the container with the now treated refuse is withdrawn. As pointed out above, determination of completion of the decomposition process may be effected by analysis of the flue gases, at the point the same is indicative of the cessation of evolution of the volatile hydrocarbons.

Thus, the foregoing is exemplary of the procedure to be followed, but with the recognition that at higher temperatures, within the limits provided, the decomposition may be accelerated, there being the obvious time/temperature relationship so that further particular plastics of the character hereunder study decompose at different temperature levels. Generally, it might be stated that maintenance of the particular temperature within the range of approximately 800°-1200° F. will effectively bring about thermal decomposition of the halogen-containing plastics.

Since such plastics, as for example, polyvinyl chloride, are finding ever broadening application in the field of metal cladding, such as for electrical insulation wire, the marked significance of the present invention is evident. Thus, scrap metal encased within a halogen-containing plastic may be just as easily charged to the bath as the plastic itself. The maintenance of the bath temperature below the point of calcination will inferentially assure that a metal melting temperature will not be reached so that as the plastic is decomposed, the metal will remain for appropriate collection. It is, of course, obvious that the present method is not restricted to the use of plastic encasing only electrical wire, but, obviously, the recovery of valuable metals as used for such wire, is a matter of substantial economic consequence.

Thus, the scrap metal as so encased is charged to the bath which is desirably fluidized in the same manner as the plastic trash above discussed and retained in said bath until thermal degradation of the plastic has been achieved. After termination of the treatment, the metal is then withdrawn and placed within a rinse tank for cooling with accompanying removal of any calcium carbonate or like particles that may have adhered thereto. If desired, the now rinsed metal may be further cleaned by well known techniques and thereafter processed in accordance with recognized procedures.

The metal recovered by the present invention will be thus in its original state since the carbonate of the bath will not react therewith and, since the atmosphere is controlled as above discussed, formation of metal oxides will be substantially inhibited.

In view of the foregoing, it is evident that the present invention constitutes a marked contribution to the important anti pollution field, as well as to metal salvage or recovery, providing a most unique solution to a multiplicity of problems heretofore besetting society.

Having described our invention what we claim and desire to obtain by Letters Patent is:

1. The method of cleaning a halogen containing plastic coating from a metallic article by thermally decomposing the plastic coating in such a manner as to prevent the escape into the ambient atmosphere of the halogen gas formed during the decomposition of the coating, said method comprising the steps of:

(a) fluidizing a bed of granular material of at least one reactive carbonate composition selected from the class consisting of alkaline earth metal carbonates, alkali metal carbonates, and combinations thereof;

(b) heating the fluidized bed to a temperature sufficient for complete thermal decomposition of the plastic coating but below the melting point of the metallic article;

(c) fully immersing the plastic coated metallic article within the heated fluidized bed for a time sufficient to complete the thermal decomposition of the plastic coating and allow any halogen gas released by the decomposition to react with the reactive carbonate material of the bed, thereby preventing any halogen containing gas from escaping into the ambient atmosphere; and (d) removing the cleaned metallic article from the bed.

2. The method of recovering metal from the condition wherein the metal is provided with an insulation coating of a halogen-containing plastic in a manner for preventing escape into the ambient atmosphere of the halogen within such plastic comprising providing metal having a coating from the class consisting of polyvinyl chloride, polyvinyl fluoride, and polyvinylidene chloride, providing a bath of at least one carbonate from the class consisting of alkaline earth metal carbonates, namely calcium carbonate, magnesium carbonate, barium carbonate, and strontium carbonate, and alkali metal carbonates, namely sodium carbonate, potassium carbonate, lithium carbonate, and combinations thereof, heating said bath to a temperature for thermal decomposition of the plastic coating but below the melting point of the coated metal, fully immersing the plastic coated metal within said bath, retaining the metal within the bath for a time interval sufficient to permit the halogen released by the decomposition to react with the bath carbonate within the bath, and then withdrawing the metal after thermal decomposition of the coating.

3. The method of recovering metal as defined in claim 2 and further characterized by the carbonate of said bath being granulated, causing a flow of air to be forced upwardly through said bath under requisite pressure for fluidization thereof, and with a temperature of said bath being maintained below that at which calcination of the bath will occur.

4. The method of recovering metal as defined in claim 2 and further characterized by the temperature of said bath being within the range of approximately 400° F. to the temperature immediately below that at which calcination of the bath will occur.

5. The method of disposing of halogen-containing plastic refuse in a manner for preventing escape into the ambient atmosphere of the halogen within such refuse comprising providing a bath of at least one carbonate from the class consisting of alkaline earth metal carbonates, namely calcium carbonate, magnesium carbonate, barium carbonate, and strontium carbonate, and alkali metal carbonates, namely sodium carbonate, potassium carbonate, lithium carbonate, and combinations thereof, heating the bath to a temperature for thermal decomposition of the plastic refuse, fully immersing the plastic refuse within said bath, maintaining said bath at the said temperature until the decomposition has been completed, and retaining the products of decomposition within said bath for a time interval sufficient to permit the halogen released by decomposition to react with the bath carbonate within the bath.

6. The method of disposing of halogen-containing plastic refuse as defined in claim 5 and further characterized by said bath carbonate being of finely divided particulate character, causing a flow of air to be forced upwardly through said bath under requisite pressure for fluidization of the same, and maintaining the temperature of said bath immediately below that at which calcination of the bath will occur.

* * * * *